United States Patent [19]

Lybecker

[11] Patent Number: 4,638,597

[45] Date of Patent: Jan. 27, 1987

[54] MODULAR AUTOMATIC GATE OPENER

[75] Inventor: Robert W. Lybecker, San Antonio, Tex.

[73] Assignee: Bomar Corporation, Inc., San Antonio, Tex.

[21] Appl. No.: 842,560

[22] Filed: Mar. 21, 1986

[51] Int. Cl.[4] ..... E05F 15/02

[52] U.S. Cl. ..... 49/340; 49/345; 49/357

[58] Field of Search ..... 49/340, 345, 344, 357, 49/380, 25, 334, 327, 324

[56] References Cited

U.S. PATENT DOCUMENTS

| | | | |
|---|---|---|---|
| 436,421 | 9/1890 | Hudler | 49/327 |
| 649,794 | 5/1900 | Ashby | 49/357 X |
| 2,592,891 | 4/1952 | Hall | 49/340 |
| 3,202,414 | 8/1965 | Simmons et al. | 49/340 X |
| 3,500,585 | 3/1970 | Voumar | 49/340 X |
| 4,231,190 | 11/1980 | Tieben | 49/25 |
| 4,416,085 | 11/1983 | Lybecker et al. | 49/340 |
| 4,429,491 | 2/1984 | Bruns | 49/340 |

*Primary Examiner*—Philip C. Kannan

*Attorney, Agent, or Firm*—Gunn, Lee & Jackson

[57] ABSTRACT

A modular gate opening apparatus comprising a mounting frame which can be used to buttress a deteriorated fence post or secured to a new fence post. A vertical portion of the frame comprises a plurality of apertures in axial alignment allowing a wide variety of fastening means to be used to secure the frame in a number of configurations. A gate-receiving bracket is hingedly secured to the frame and is adapted to accomodate a wide variety of gate sizes. Actuator means are provided to move the gate receiving bracket, and the gate carried thereon, between an open and a closed position.

11 Claims, 7 Drawing Figures

MODULAR AUTOMATIC GATE OPENER

FIELD OF THE INVENTION

The present invention relates to a modular automatic gate opener and, more particularly, to a modular automatic gate opening device that can be quickly and easily installed on existing fences in remote locations.

BACKGROUND

Persons living in remote locations, such as ranches having a large amount of fenced acreage, experience considerable inconvenience in continually having to stop to open and close gates. This problem is particularly acute in areas where an individual must cross a large number of fenced-in sections in order to reach his destination. Although an automatic gate opening device can solve the inconvenience of opening and closing a large number of gates at remote locations, there are a number of practical and economic difficulties in utilizing such gate openers. In particular, it is very common for the fencing on which the gate is to be installed to have wooden posts which have deteriorated with age. In such cases, it is often necessary to construct a custom-built gate frame to be used in conjunction with the gate opener. Construction of such a frame tends to be very costly and time consuming. Furthermore, once such a frame has been constructed and a gate opener has been installed thereon, the user must bear the additional expense of having commercially available power routed to the gate opener.

A gate opener overcoming the above mentioned difficulty with regard to power is shown in U.S. Pat. No. 4,416,085, which is owned in part by applicant and by this reference incorporated for all purposes. The gate opener shown in said patent is operated by a hydraulic cylinder controlled by a bi-directional gear pump with the cylinder comprising a rod connected to a pivotal linkage which is operable to open and close the gate. A solar power system is provided to maintain a battery in a charged state to provide power for the system.

Various other types of gate or door opening devices have been designed in the past to utilize hydraulic cylinders and a mechanical linkage. A typical device is shown in U.S. Pat. No. 3,936,977 issued to Runft, et al., which has a double acting power cylinder. A pivotal interconnecting linkage is utilized to open a door in response to the movement of a piston within the cylinder.

Other types of gate opening devices have utilized a ram such as that shown in U.S. Pat. No. 3,500,585 to Vollmar. Further examples of gate opening devices are shown in U.S. Pat. No. 3,645,042, issued to Bolli; U.S. Pat. No. 2,592,891 issued to Hall; and U.S. Pat. No. 4,231,190 issued to Tieben.

SUMMARY OF THE INVENTION

The modular gate opening device shown in the present invention represents an improvement over previous gate opening devices, including applicant's gate opening device shown in U.S. Pat. No. 4,416,085. The invention gate opening device comprises a modular frame assembly which can be constructed at a manufacturing facility and delivered to a remote location as a single unit.

The opener comprises a frame which may be used to replace or to buttress a deteriorated fence post or, alternatively, can be secured via a bracket assembly to a new fence post. A gate receiving bracket is hingedly attached to the frame and is adapted to sweep an arc of approximately 90° between a closed position wherein the gate carried by the bracket is in closed relation with the fence and a open position wherein the bracket is in contact with a limiting switch attached to the frame. A single sized bracket can be adapted to receive a wide variety of gate sizes, thereby allowing a single modular unit to be employed in a wide variety of circumstances. Movement of the gate-receiving bracket is controlled by a pivotal linkage which is actuated by a mechanical screw jack assembly which is pivotally secured to the frame.

A vertical portion of the frame comprises a plurality of apertures in axial alignment allowing a wide variety of fastening means to be utilized in order to secure the frame assembly in a number of different configurations. In one configuration, a bolt is received through upper and lower aligned pairs of apertures to secure the vertical portion of the frame assembly to an existing fence post. In a second configuration, a vertical shaft is secured in the ground and the shaft can then be received in a complimentary channel extending the length of the vertical portion of the frame assembly. In this configuration, a plurality of bolts are received in upper and lower apertures in order to secure the frame to the shaft and to align the vertical portion of the frame in a desired vertical position. Finally, in a third mounting configuration, the apertures can be used to receive bolts which pass through brackets secured to a new fence post.

DESCRIPTION OF THE PREFERRED EMBODIMENT

Figure 1:
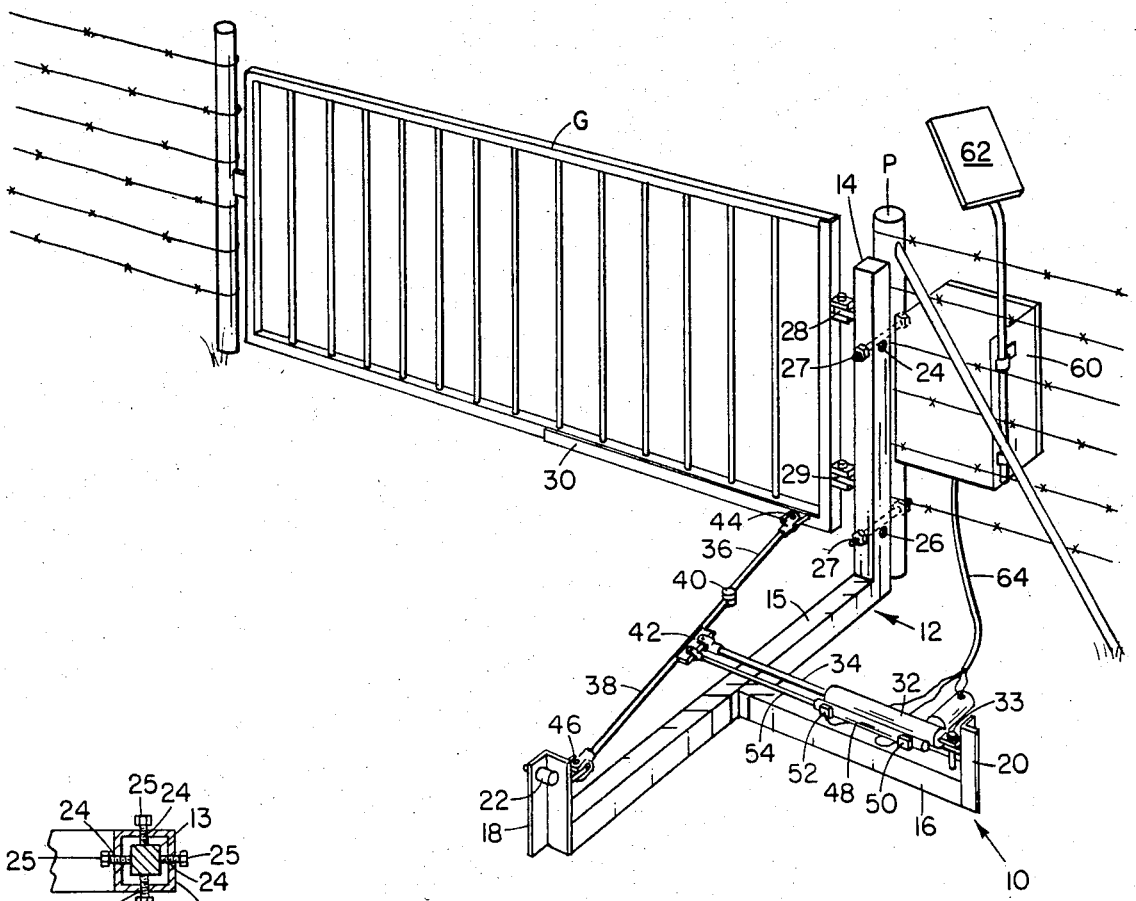
FIG. 1 is a perspective view of the invention automatic gate opener as installed on a fence.
Figure 2:
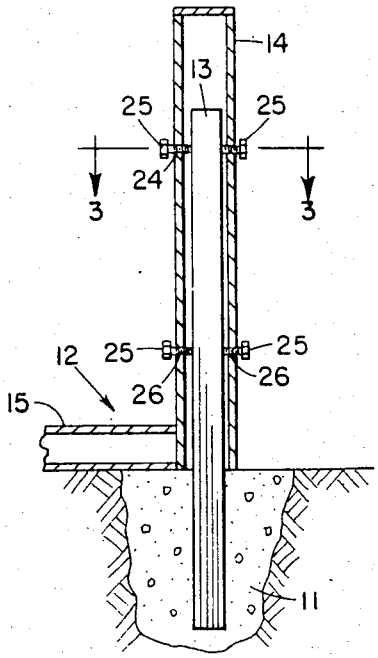
FIG. 2 is a partial cross sectional side view of the vertical portion of the frame assembly showing details relating to mounting of the frame assembly over a shaft secured in the ground.
Figure 5:
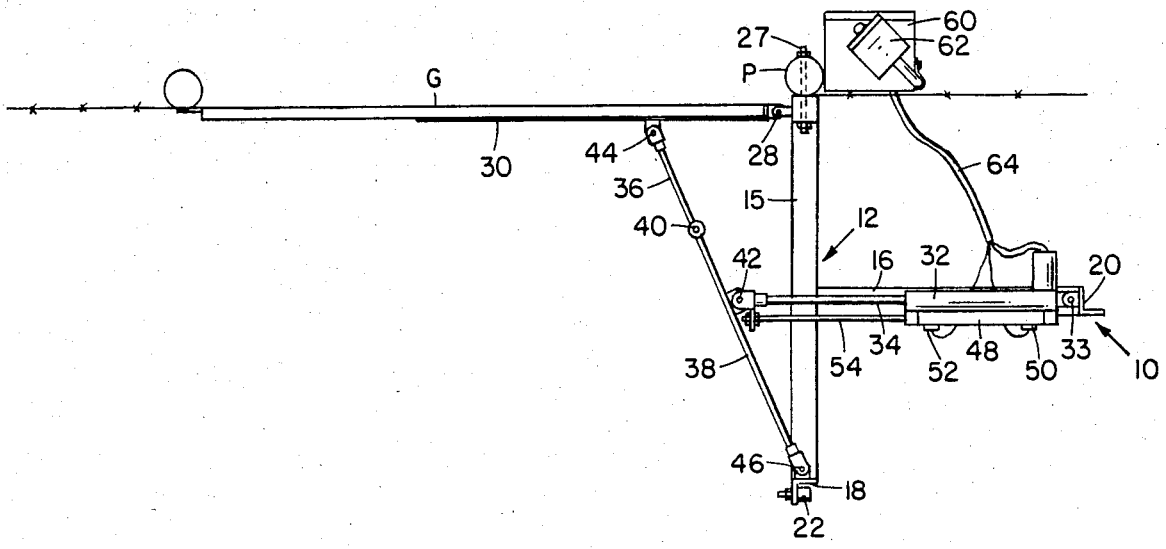
FIG. 5 is a pictorial overhead view of the invention automatic gate opener with the gate in the closed position.
Figure 6:
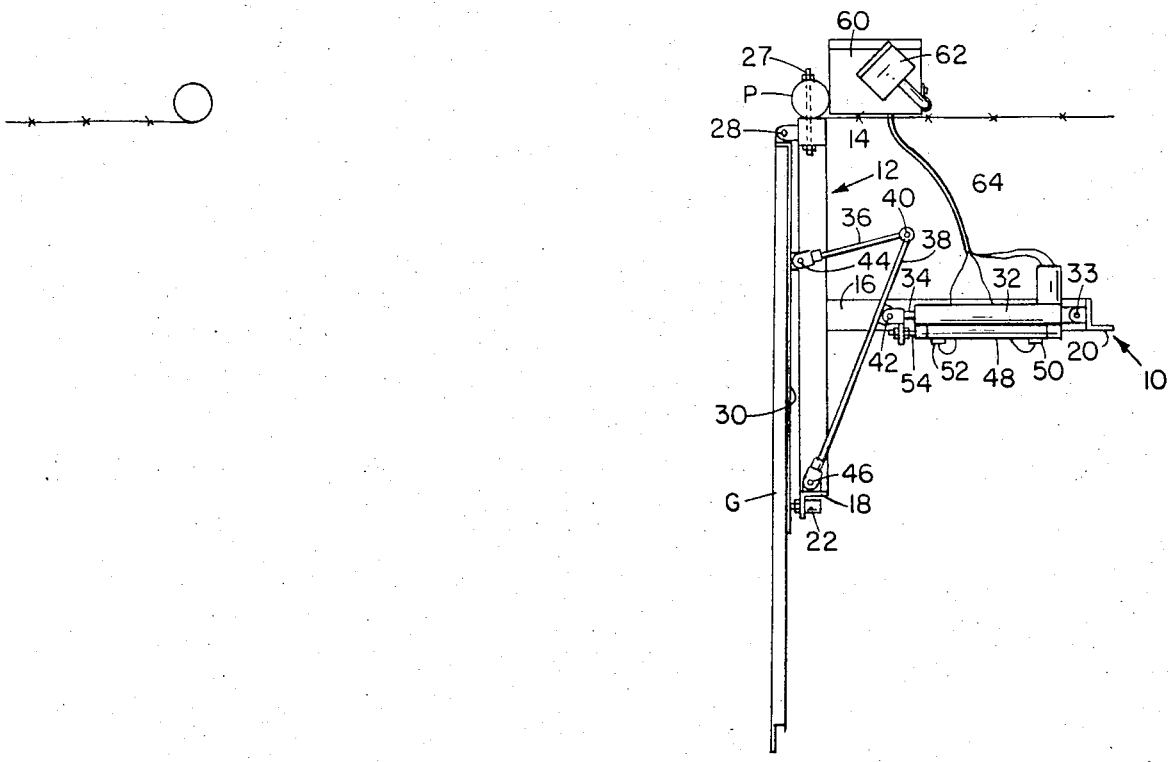
FIG. 6 is a pictorial overhead view of the invention automatic gate opener showing the gate in the open position.

Referring to FIGS. 1 and 2 in the drawings in combination, there is shown the modular automatic gate opening device 10 of the present invention as installed on a fence. The device comprises a frame assembly 12 including a vertical member 14 and horizontal members 15 and 16. As can be seen in FIG. 1, the vertical member 14 and horizontal member 15 form a generally L-shaped portion, while the horizontal members 15 and 16 form a generally T-shaped lower assembly as shown in FIGS. 5 and 6. As can be seen in FIG. 1, a vertical mounting bracket 18 is attached to the horizontal member 15 at a point distal to the point of attachment of member 15 to vertical member 14. Similarly, a mounting bracket 20, used to secure the linear actuator 32 as described hereinbelow, is attached to the horizontal member 16 at the end which is distal to the point of connection of member 16 with 15. A shock absorber 22, to be used in conjunction with the gate-receiving bracket 30 in a manner as described below, is attached to the mounting bracket 18.

Referring to FIG. 1, it can be seen that an L-shaped gate-receiving bracket 30 is hingedly secured to the vertical member 14 of the frame assembly 12 by upper and lower hinge assemblies 28 and 29, respectively. A gate G, shown in FIG. 1, is received in the gate bracket 30 and secured thereto. Although the gate in FIG. 1 is substantially longer than the horizontal length of the bracket 30, it is to be understood that the bracket 30 is intended to accommodate a wide variety of gate sizes ranging from one having a length approximately the same as the horizontal length of the bracket 30 to one having a length of as much as two-and-one-half times the length of the bracket 30. The gate-receiving bracket 30 is adapted to sweep an arc of approximately 90° from the closed position shown in FIGS. 1 and 5 to the open position in FIG. 6.

Movement of the gate is controlled by a pivotal linkage assembly comprising pivot arms 36 and 38 which are hingedly attached at pivot point 40, as shown in FIG. 1. The pivot arm 36 is attached to the gate bracket 30 by a hinge assembly 44 and the pivot arm 38 is similarly secured to the vertical mounting bracket 18 by a hinge assembly 46. As can be seen in FIGS. 1 and 5, when the gate G is in the closed position, the linkage assembly is in a generally linear configuration with pivot arms 36 and 38 in axial alignment. With the gate in the open position, shown in FIG. 6, pivot arms 36 and 38 form an acute angle with respect to the pivot point 40.

In the preferred embodiment, movement of the pivot arms is controlled by a linear actuator in the form of a motorized mechanical screw jack 32 having an extendible shaft 34 secured to the pivot arm 38 by a hinge assembly 42. The linear actuator 32 is hingedly secured to the mounting bracket 20 by a hinge assembly 33 as shown in FIGS. 1, 5 and 6. The screw jack 32, therefore, is able to pivot in response to the changing orientation of the pivot arms 36 and 38 as the shaft 34 is retracted into the screw jack 32 in order to move the gate-receiving bracket 30 from the open position to the closed position. As the gate G nears the closed position, pivot arms 36 and 38 move into alignment and provide a smooth deceleration for the gate G as it moves into the closed position. In the closed position, pivot arms 36 and 38 are in alignment providing a mechanical lock for the gate G.

As the gate nears the fully open position shown in FIG. 6, the gate bracket 30 strikes a shock absorber 22, thereby cushioning the impact of the bracket on the frame assembly 12. When the gate G reaches the fully open position, a limit switch 48, described below, interrupts power to the linear actuator 32.

The electrical limit switch unit 48 has an extendible shaft 54 which is attached to hinge bracket 42 and is operable to electrically interrupt operation of the screw jack 32 when the screw jack reaches an outer or an inner position defined by the gate G being in the open or closed position. With the shaft 54 in the fully extended position shown in FIG. 5, the terminal end of the shaft inside of the housing 48 magnetically trips an outer stop switch 52 to stop operation of the motor of the screw jack 32 once the gate has reached the closed position. As the shaft 54 travels inwardly in conjunction with the travel of the screw jack shaft 34, the shaft magnetically trips an outer stop switch 50 to stop the operation of the screw jack 32 once the gate has reached the open position shown in FIG. 6.

Control cables and power lines for the screw jack 32, the stop switch unit 48, and the stop switches 50 and 52 are contained in a cable bundle 64 which runs from a control box 60 to the above mentioned functional elements. Electricity to power the circuitry and the functional components of the system can be provided either by conventional power sources or by a solar collector panel 62 shown in FIG. 1.

The control circuitry used in the present invention is substantially similar to that shown in U.S. Pat. No. 4,416,085 which has been incorporated by reference. The control circuitry can thus be actuated by remote control radio signals, by magnetic vehicle sensors, or by a manual switch. In the preferred embodiment, electric power for the system is provided by a storage battery which is maintained in a charged state by a solar collector or by a conventional battery charger.

The invention gate opening system is designed to be used in conjunction with any number of suitable linear actuators, including the hydraulic cylinder shown in the above-referenced patent. In the preferred embodiment, however, the bi-directional gear pump and the hydraulic cylinder have been eliminated and the electric motor of the mechanical screw jack 32 of the present invention is directly activated by the solid state motor switch 76 shown in FIG. 5 of the referenced patent. Therefore, in the preferred embodiment, the linear actuator or screw jack 32 is connected directly to the linkage for moving the gate G rather than operating the linkage indirectly by means of a fluid pump controlling a hydraulic cylinder.

Details relating to the mounting of the frame assembly 12 can be seen by referring to FIGS. 1, 2, 3, 4 and 7. The vertical member 14 of the frame assembly 12 has upper and lower sets of 4-way apertures, 24 and 26, respectively,. The sets of 4-way apertures each comprise pairs of axially aligned apertures in opposing faces of vertical member 14. These sets of apertures can be used to mount the gate opener frame assembly 12 in a wide variety of configurations, as described below.

In the mounting configuration shown in FIG. 1, the frame assembly 12 is secured to an existing fence post P by bolts 27 received through axially aligned upper and lower pairs of apertures 24 and 26 and secured to a fence post P. The fence post P in this configuration is assumed to be properly aligned in a vertical configuration.

Figure 3:
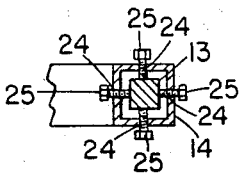
FIG. 3 is a cross sectional top view taken along lines 3—3 of FIG. 2 showing the alignment of the vertical portion of the frame over a shaft using set screws.

In an alternate mounting arrangement, shown in FIGS. 2 and 3, a shaft 13 is secured in the ground by a mass of concrete 11. The frame assembly 12 is then mounted over the shaft 13, with the shaft 13 received in a longitudinal channel extending substantially the length of the vertical portion of the vertical member 14 of the frame assembly 12. As can be seen in FIGS. 2 and 3, the shaft 13 is of reduced dimension with respect to the channel inside the vertical member 14. A plurality of set screws 25 are received in upper and lower apertures 24 and 26, respectively, and can be adjusted to align the upper member 14 with the vertical shaft 13, as shown in FIG. 3. Alignment of the frame assembly 12 in this manner allows a precise vertical orientation for the vertical member 14 thus avoiding undue strain on the hinge assemblies 28 and 29 as the gate bracket is rotated from the open position to the closed position.

Figure 4:
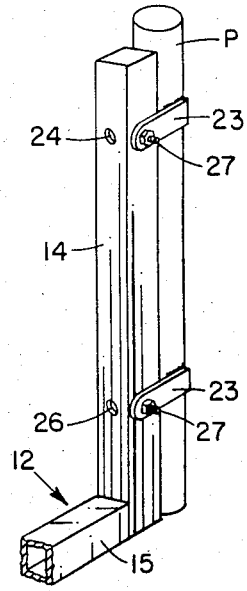
FIG. 4 is a perspective view showing an alternate arrangement for mounting the frame assembly using brackets welded to a new fence post.

Another mounting arrangement is shown in FIG. 4. In this configuration, a new fence post P is assumed to be properly aligned in a vertical configuration. The modular frame assembly 12 can then be mounted in alignment with the fence post P by welding brackets 23 in upper and lower positions on the fence post P at points which coincide with complimentary upper and lower apertures 24 and 26, respectively, on the vertical member 14 of the frame assembly 12. The frame assembly may thus be secured to the fence post by bolts 27 received through the upper and lower apertures 24 and 26, respectively, and through brackets 23 which are secured to the fence post P.

Figure 7:
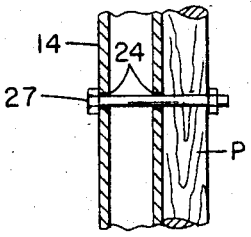
FIG. 7 is a cross sectional side view showing details relating to the mounting of the frame assembly to an existing fence post by using a bolt received through apertures in the frame assembly.

Finally, the fence post can be secured to an existing wooden post in the manner shown in FIG. 7. In this configuration, the vertical member 14 of the frame 12 is secured to an existing fence post P by securing bolts 27 through axially aligned pairs of upper and lower apertures 24 and 26, respectively, and through horizontal channels in the post P.

The invention gate opener apparatus offers numerous functional and economic advantages over previous gate opening devices. Since a single size of gate-receiving bracket can be adapted to fit a wide variety of gate sizes, the invention gate opening apparatus can be assembled at a manufacturing facility and installed at a remote location without the need for extensive custom installation. Furthermore, the gate-receiving bracket and the actuator linkage are mounted on the opener frame with a predetermined geometry which further minimizes the need for custom installation. The ability to precisely align the various frame components at the manufacturing facility ensures that the moving components operate with a minimal amount of stress and friction. Finally, the solar power system and automatic control circuitry make the invention gate opening system ideally suited for use in remote locations.

Although the invention modular automatic gate opening apparatus has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. An automatic gate opening apparatus, comprising:

a frame assembly comprising a vertical portion, said vertical portion of said frame assembly comprising a shaft having a generally square cross-section and a plurality of axially aligned apertures in opposing faces of said shaft, a horizontal portion, and a gate-receiving means hingedly secured to said vertical portion, said vertical and horizontal portions being attached in a predetermined fixed relationship, said horizontal portion comprising first and second mounting means;

a linkage assembly hinged secured on one end to said first mounted means and hingedly secured on the other end to said gate-receiving means;

actuator means hingedly secured on one end to said second mounted means said actuator comprising an extendible shaft having one end received in said actuator and having the other end attached to said linkage assembly;

control means connected to said actuator means for operating said actuator; and sensor means for signaling said control means to activate said actuator means, thereby causing said sahft of said actuator means to move said gate-receiving bracket between said open and said closed position.

2. An automatic gate opener according to claim 1, said linkage assembly comprising members which are in axial alignment with each other in said closed position, said alignment of said members creating a locking force to releasably retain said gate in said closed position.

3. An automatic gate opening apparatus according to claim 1, said gate receiving means comprising an L-shaped bracket hingedly attached to said vertical portion of said frame assembly.

4. An automatic gate opening apparatus according to claim 1, said plurality of apertures comprising at least two apertures adapted to be aligned with a complimentary aperture in a fence post and further adapted to receive a fastening means therethrough to secure said frame assembly to said post.

5. An automatic gate opening apparatus according to claim 1, said shaft having an internal channel extending substantially the length of said shaft, said channel adapted to receive a mounting post, said plurality of apertures comprising at least two pairs of axially aligned apertures, said pairs of apertures adapted to receive threaded members to secure said shaft and said frame assembly to said mounting post.

6. An automatic gate opening apparatus according to claim 1, said plurality of apertures comprising at least two apertures adapted to be aligned with complimentary apertures in mounting brackets secured to a mounting post, said apertures and said complimentary apertures having a fastening means received therein to secure said vertical portion of said frame assembly to said mounting post.

7. An automatic gate opening apparatus according to claims 4, 5 or 6, said actuator means comprising a mechanical screw jack.

8. An automatic gate opener according to claims 4, 5, or 6, said actuator means comprising a hydraulic cylinder.

9. An automatic gate opener according to claims 4, 5, or 6, said actuator means comprising a pneumatic cylinder.

10. A method of mounting an automatic gate opening apparatus to a fence and gate comprising the steps of:

securing a vertical portion of a frame assembly to said fence wherein said frame assembly comprises (1) first mounting means and (2) second mounting means, (3) said vertical portion and (4) a horizontal portion; said vertical portion, said first mounting means and said second mounting means being fixedly attached to said horizontal portion at a predetermined distance from each other;

pivotally mounting a first portion of actuator means to said first mounting means of said frame assembly and pivotally mounting a second portion of said actuator means to a linkage assembly; and pivotally affixing a first portion of said linkage assembly to said second mounting means of said frame assembly and pivotally affixing a second portion of said linkage assembly to said gate.

11. The method of mounting an automatic gate opening apparatus to a fence and a gate as described in claim 10 further comprising the steps of:

mounting said actuator measn wherein a first end of an extendable shaft of said actuator means linearly extends from or retracts into said actuator means; and attaching a second end of said extendable shaft to said linkage assembly.

* * * * *